US008308122B1

(12) United States Patent
Wadia

(10) Patent No.: US 8,308,122 B1
(45) Date of Patent: Nov. 13, 2012

(54) PICTURE HANGING DEVICE

(76) Inventor: Rustam N. Wadia, Charlotte, NC (US)

( * ) Notice: Subject to any disclaimer, the term of this patent is extended or adjusted under 35 U.S.C. 154(b) by 0 days.

(21) Appl. No.: 13/154,568

(22) Filed: Jun. 7, 2011

(51) Int. Cl.
*A47G 1/16* (2006.01)

(52) U.S. Cl. ..... 248/475.1; 248/466; 248/497

(58) Field of Classification Search ..... 248/466, 248/475.1, 476, 497, 489
See application file for complete search history.

(56) References Cited

U.S. PATENT DOCUMENTS 2,464,295 A * 3/1949 Edgar ..... 248/489
3,020,013 A * 2/1962 Ochin et al. ..... 248/493
5,878,988 A * 3/1999 Rakower ..... 248/497
7,667,137 B1 * 2/2010 Beckman ..... 174/58
7,690,129 B2 * 4/2010 Bender ..... 33/613
8,113,476 B2 * 2/2012 Serio ..... 248/308
2010/0219323 A1 * 9/2010 Ernst et al. ..... 248/475.1

* cited by examiner

*Primary Examiner* — Amy J Sterling
(74) *Attorney, Agent, or Firm* — Clements Bernard PLLC; Seth L. Hudson

(57) ABSTRACT

The present invention provides methods and systems for a picture hanging device for mounting a picture to a retention member engaged to a wall that includes a tube having a top portion and a bottom portion, the bottom portion of the tube is designed to receive a retention member mounted to a wall, the top portion of the tube extends into the air for correctly aligning the picture on the retention member, whereby a hanging mechanism engaged to the picture is positioned about the tube and is slide down the tube for engagement to the retention member and the tube is positioned within the center of the picture for correctly aligning the picture on the retention member.

2 Claims, 4 Drawing Sheets

PICTURE HANGING DEVICE

FIELD OF THE INVENTION

The present invention relates generally to a picture hanging device, and more specifically relates to a device for accurately and precisely positioning a picture, mirror, or the like on a retention member or retention members engaged to a wall or like surface.

BACKGROUND OF THE INVENTION

The art of hanging a picture, mirror, or the like can be a tedious process. A retention member or retention members must be placed on a wall at a desired height and then the picture, mirror, or the like must be correctly positioned on the retention member. Many pictures and mirrors either contain a hanging wire or hanging hook on the rear of the picture or mirror for positioning the picture or mirror on the retention member. The act of positioning the hanging wire or hanging hook correctly on the retention member can be challenging. Additionally, the act of straightening the picture or mirror while it is engaged to the retention member can be equally challenging.

There is a need for a device that easily allows a user to position the hanging wire or hanging hook of a mirror or picture on a retention member positioned on a wall. There is also a need for a device that easily allows a user to accurately align the picture or mirror on the retention member.

BRIEF SUMMARY OF THE INVENTION

According to an embodiment of the invention, the present invention is a picture hanging device for mounting a picture to a retention member engaged to a wall. The picture hanging device includes a tube having a top portion and a bottom portion, a bottom portion of the tube that is designed to receive a retention member mounted to a wall, and the top portion of the tube extends into the air for correctly aligning the picture on the retention member. The hanging mechanism is engaged to the picture and is positioned around the tube and is slid down the tube for engagement to the retention member and the tube is positioned within the center of the picture for correctly aligning the picture on the retention member.

According to another embodiment of the present invention, the tube is generally cylindrical.

According to yet another embodiment of the present invention, the top portion of the tube is crimped, closed-in, or flattened.

According to yet another embodiment of the present invention, the tube is composed of plastic.

According to yet another embodiment of the present invention, the retention member has an upper portion that is bent in upon itself and has a bore extending therethrough.

According to yet another embodiment of the present invention, a method for hanging a picture that includes providing a retention member, a nail, a picture having a hanging mechanism, and a tube having a top portion and a bottom portion. The retention member is placed on the wall and the retention member is attached to the wall using the nail. The tube is engaged to the bottom portion of the retention member, the hanging mechanism of the picture is placed over the tube, and the hanging mechanism is slid down the tube until the hanging mechanism is engaged to the retention member.

According to yet another embodiment of the present invention, a kit of parts for hanging a picture that includes at least one retention member, at least one nail and at least one tube for engaging the retention member.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

Figure 1:
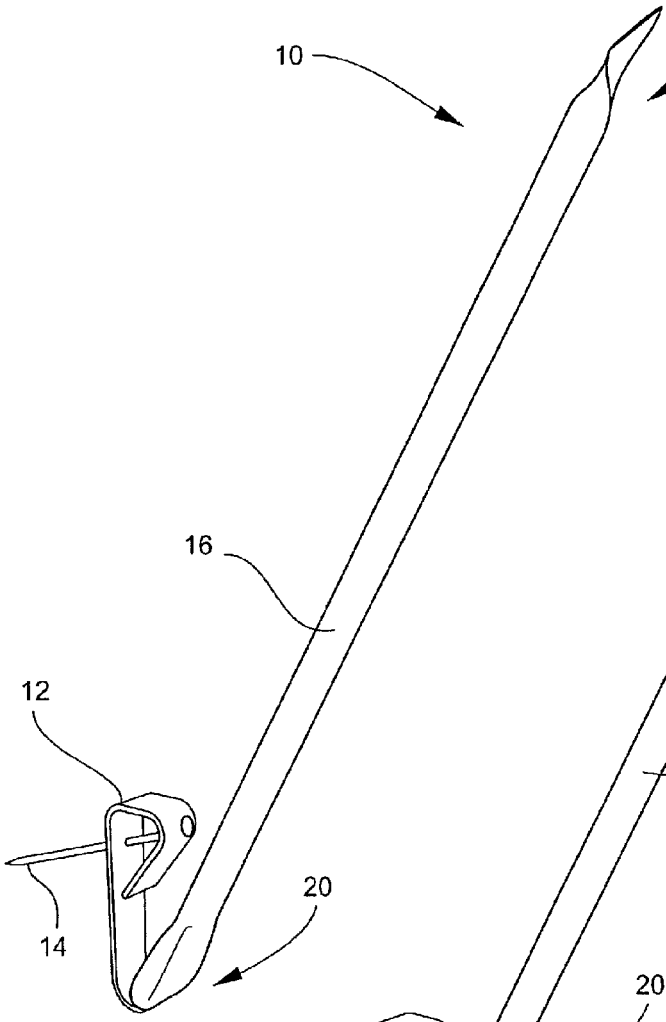
FIG. 1 is a perspective view of the picture hanging device.
Figure 2:
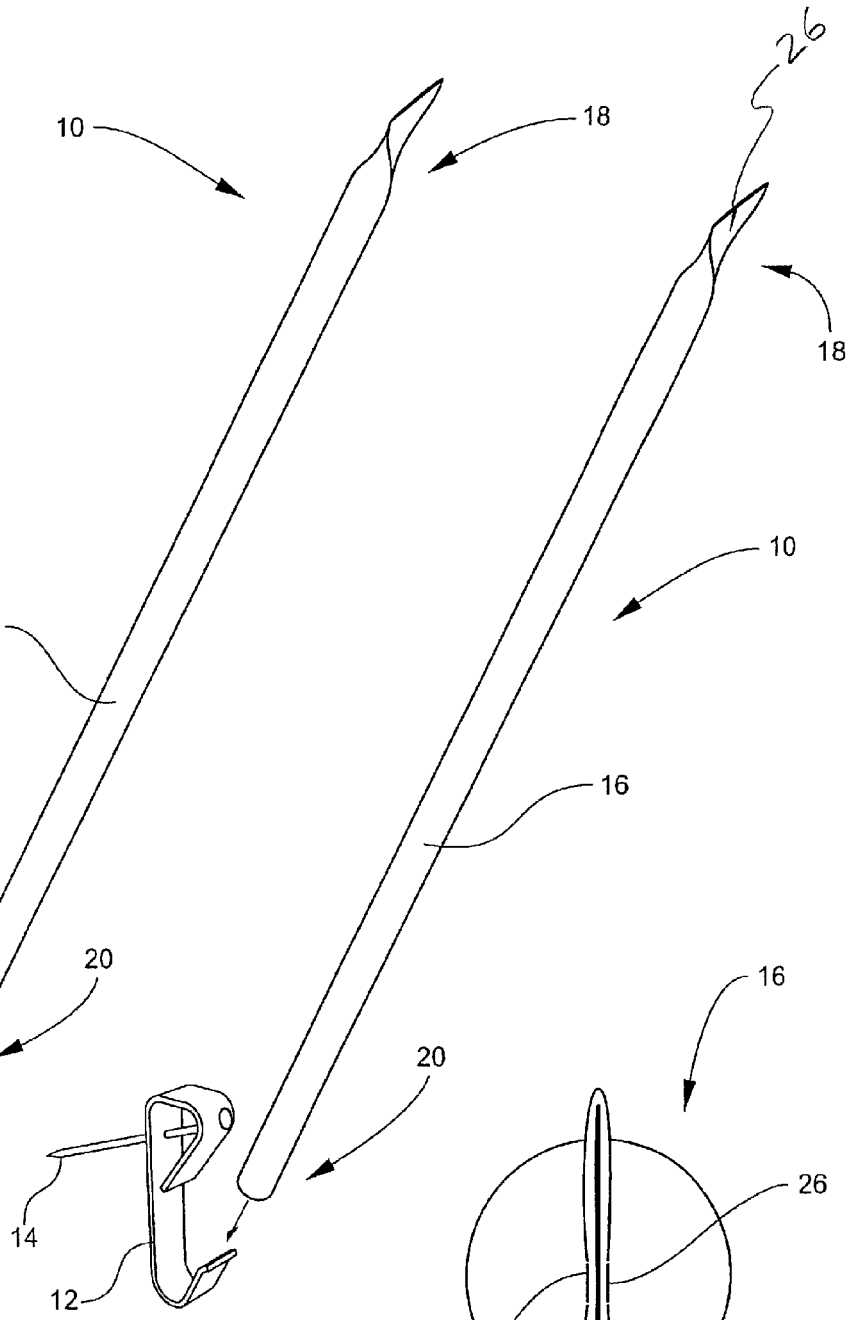
FIG. 2 is another perspective view of the picture hanging device.

Referring now specifically to the drawings, a picture hanging device is illustrated in FIGS. 1 and 2 and is shown generally at reference numeral 10. The device 10 includes a retention member 12, a nail 14, and a tube 16. The tube 16 is a generally cylindrical tube that has a top portion 18 and a bottom portion 20. The retention member 12 has an upper portion and a lower portion. The lower portion of the retention member 12 is angled upward to receive a hanging mechanism of a picture 24. The upper portion of the retention member 12 is designed to receive the nail 14 and the lower portion of the retention member 12 is designed to receive the bottom portion 20 of the tube 16.

The retention member 12 is designed to be engaged to a wall 22 or other like structure. Preferably, the retention member 12 is a standard picture bracket that is one, solid piece. The upper portion of the retention member 12 is bent in upon itself and has a bore extending therethrough. The bore is designed to receive the nail 14 for engaging the retention member 12 to the wall 22.

In addition to receiving the hanging mechanism of a picture 24, the lower portion of the retention member 12 also receives the bottom portion 20 of the tube 16. When the tube 16 is positioned on the lower portion of the retention member 12, the tube 16 extends upward at an angle. The tube 16 is designed to receive the hanging mechanism of a picture 24 for engaging the hanging mechanism to the lower portion of the retention member 12.

Although the tube 16 is preferably generally cylindrical, it may be any shape as required by the user. It also should be noted that the tube 16 may have any length, width, or diameter that is desired by the user. However, it is preferred that the length of the tube 16 is a length that would extend above the top of a picture 24, when the hanging mechanism of the picture 24 is engaged to the lower portion of the retention member 12. Preferably, the tube 16 extends above the top of the picture 24 a length of about 1 inch or more. However, a person of ordinary skill in the art will recognize that the tube 16 can extend any distance above the top of the picture 24 as desired by the user.

The term hanging mechanism of the picture 24 is generally a term meaning the mechanism or device located on the picture 24 for suspending the picture 24 from the retention member 12. Generally, the hanging mechanism consists of a hook, a wire, a string, a nylon string, or the like that is positioned on the back of the picture 24. It should also be noted that picture may be interchanged with a minor, or other like structure that a user may desire to hang from the wall 22 or other support structure.

Figure 7:
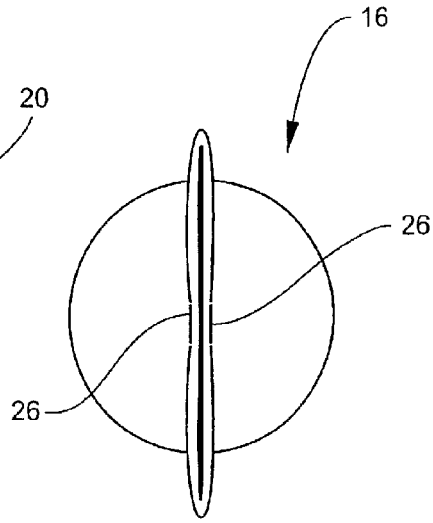
FIG. 7 is a top view of the tube of the present invention.

As illustrated in FIG. 7, the top portion 18 of the tube 16 is closed-in on itself and has a center point 26. In other words, the top portion 18 is flattened or crimped and both sides are engaged to one another. The tube 16 has a constant inner and outer circumference. However, one of ordinary in the art will recognize that the inner and outer circumference of the tube 16 may have differing or varying inner and outer circumferences based upon the desires of the user. It will be noted that the top portion 18 may have any shape that is desired by the user.

Figure 3:
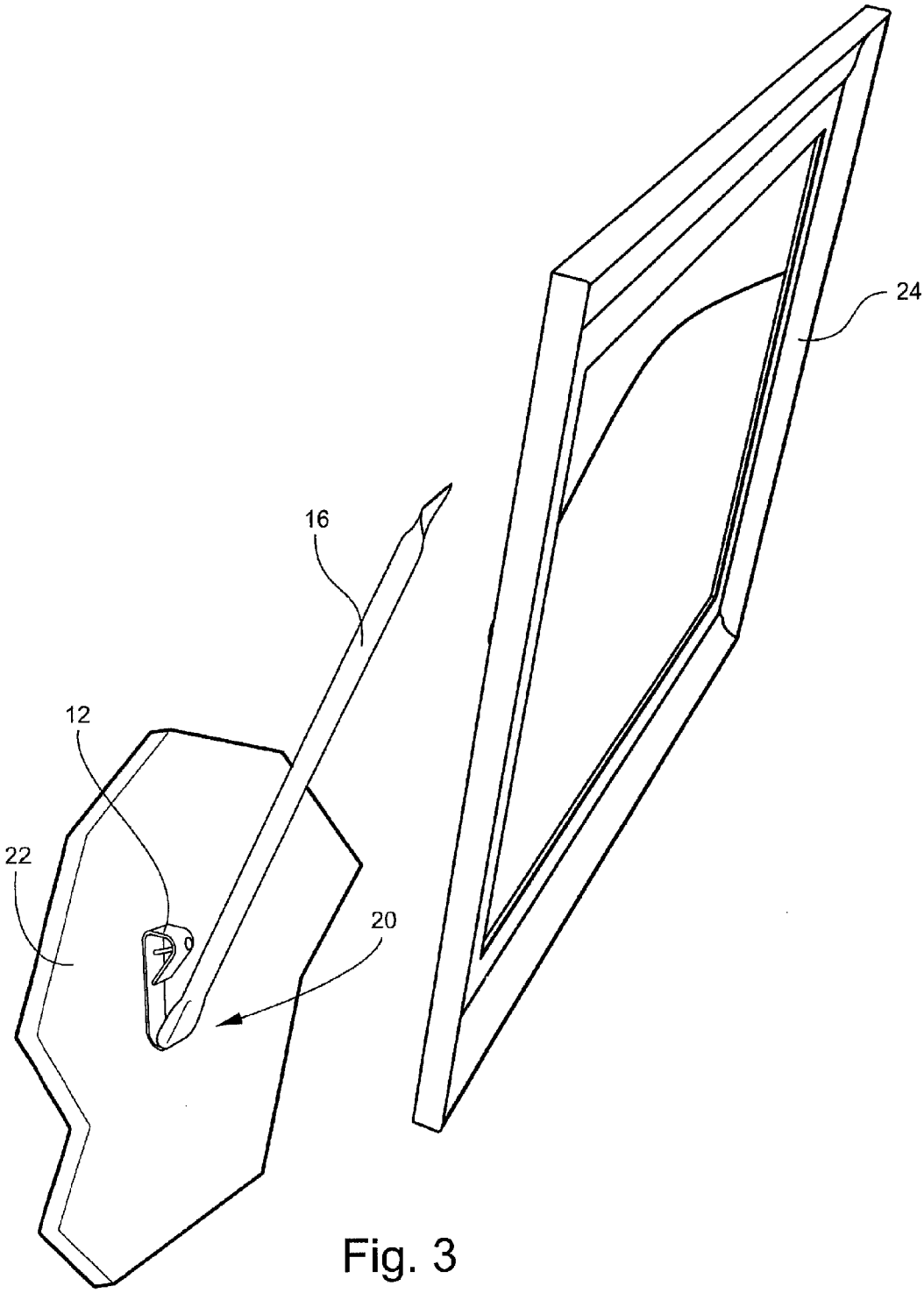
FIG. 3 is a perspective view of the picture hanging device mounted to a wall and a picture about to be installed on the picture hanging device.
Figure 4:
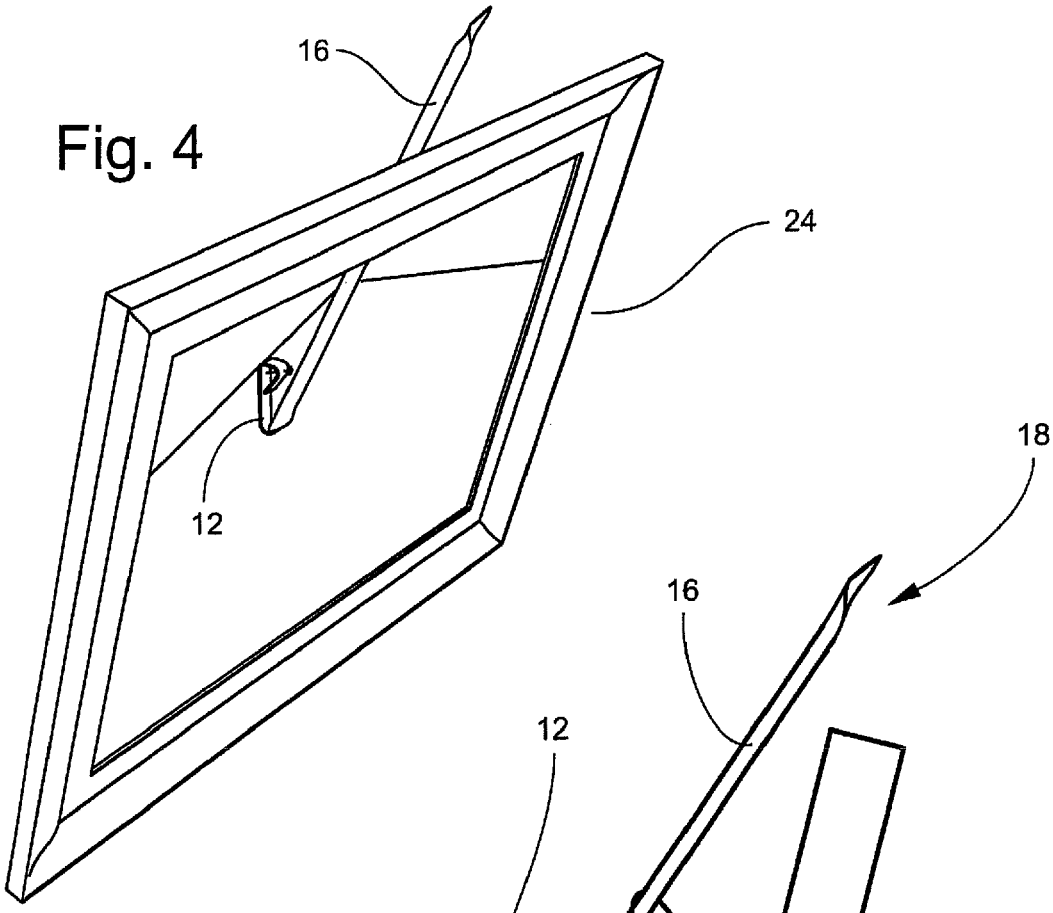
FIG. 4 is a perspective view of a picture inserted on the picture hanging device.
Figure 5:
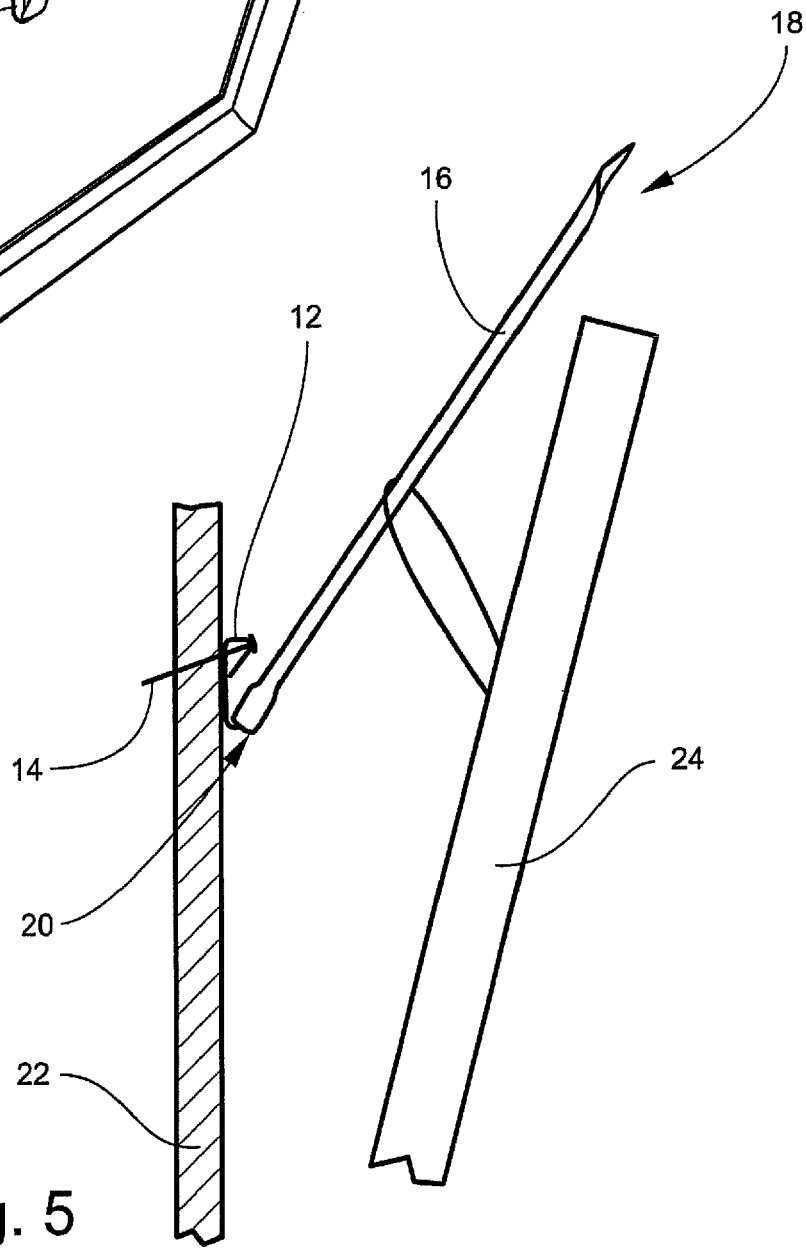
FIG. 5 is a side view of a picture inserted on the picture hanging device.

During use, the retention member 12 is engaged to the wall 22 with the nail 14, as illustrated in FIGS. 3, 4, and 5. The bottom portion 20 of the tube 16 is engaged to the lower portion of the retention member 12. Preferably, the tube 16 is hollow and the lower portion of the retention member 12 is inserted into the bottom portion 20 of the tube 16 and is retained therein by friction fit. The top portion 18 of the tube 16 is closed-in or crimped and the closed-in or crimped side is positioned parallel to the wall 22.

The hanging mechanism of the picture 24 is positioned over or around the tube 16, as illustrated in FIGS. 4 and 5. In other words, the tube 16 is positioned between the hanging mechanism and the picture 24 with the hanging mechanism positioned around the tube 16 when the hanging mechanism is a wire or the like. If the hanging mechanism is a hook or the like, the tube 16 is positioned within the hook with the hook around the tube 16. The hanging mechanism and picture 24 is slid down the tube, until the hanging mechanism is engaged to the lower portion of the retention member 12. A user will be able to determine whether the tube 16 is positioned between the hanging mechanism and the picture (or within the hanging mechanism should the hanging mechanism be a hook or the like) by moving the picture 24 towards and away from the wall 22 because the tube 16 will move in conjunction with the picture 24. When the hanging mechanism is engaged to the retention member 12, the tube 16 extends above the picture 24, as shown in FIG. 4.

Figure 6:
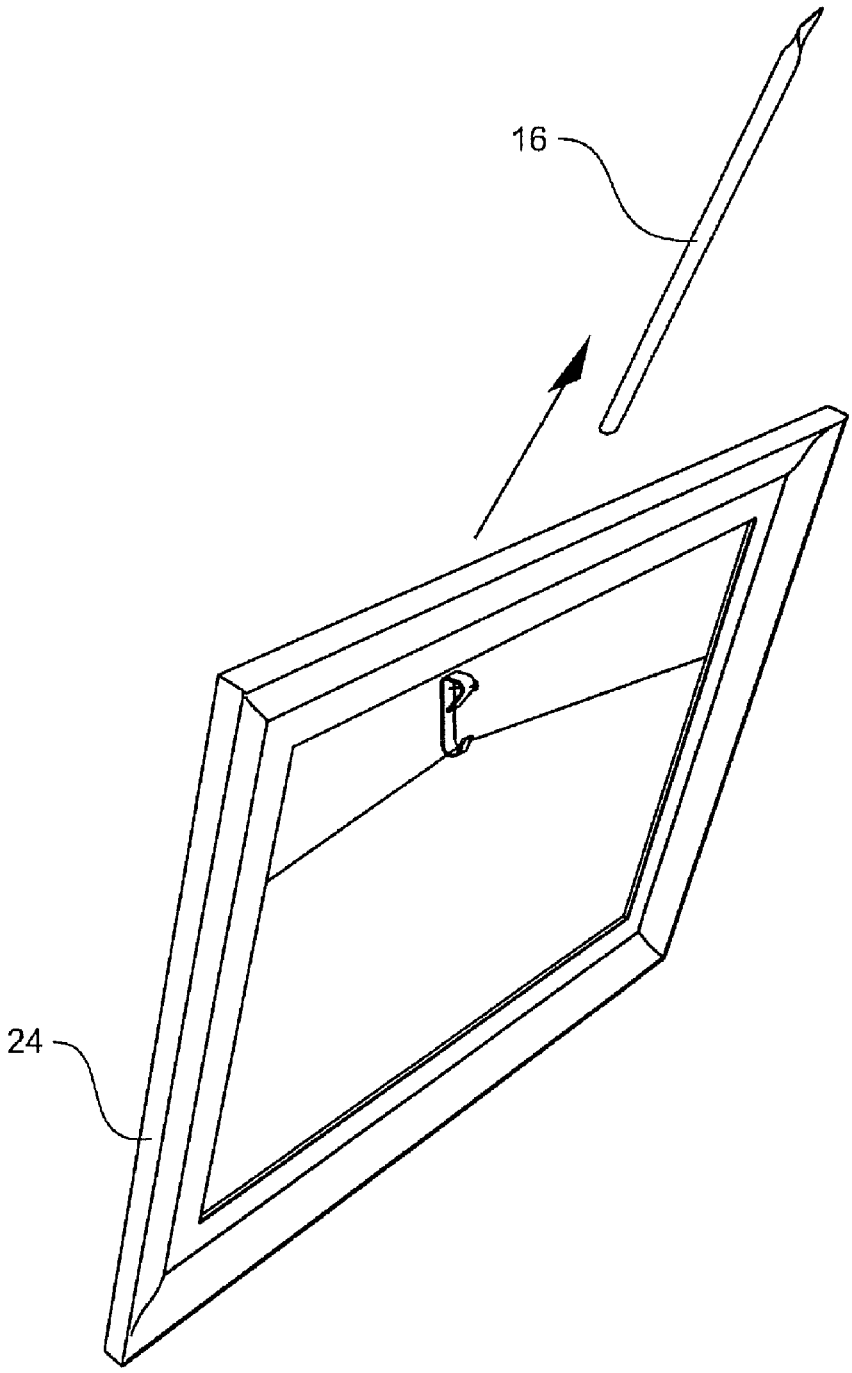
FIG. 6 is a perspective view of the tube being removed from the retention member of the picture hanging device.

Once the hanging mechanism is engaged to the retention member 12, the user may utilize a measuring tape to determine the center portion of the picture 24. This center portion may be marked utilizing a pencil, tape, or another marking device or mechanism that can be removed easily from the picture 24 without leaving a mark. The picture 24 can be moved to the left or right to ensure the center of the picture 24 is aligned with the tube 16. The tube 16 may also include an indicator or mark 26 that indicates the center of the tube 16 for enabling the user to position the center of the picture 24 with the center of the tube 16. Further, the user may apply a level to ensure the picture is hanging level. Afterwards, the tube 16 is disengaged from the retention member 12 by pulling the tube 16 upwards, as illustrated in FIG. 6.

The retention member 12 may also be a self-adhering plastic bracket, such as the Command™ line of brackets or hooks from the 3M Corporation. The retention member 12 may also be a cloth bracket, a nail, or the like. The retention member 12 may be anything that is engaged to a wall that receives a picture or mirror and holds the picture or mirror on the wall. The retention member 12 may be a standard picture hanging bracket that one of ordinary skill in the art would understand and purchase. In another embodiment, the retention member 12 is a metal picture bracket as illustrated in FIGS. 1 and 2.

A kit of goods is disclosed herein. The kit may include a retention member 12, a nail 14, and a tube 16 for accurately and efficiently hanging a picture 24. The kit may be situated in a bag, box or other suitable packaging for retaining the items in the kit. The kit may also include a hanger, a bore or the like for hanging the kit on a display shelf. Additionally, the kit may include a hanging mechanism, such as a wire, hook, eye hook, string, nylon string, a nail, at least two nails, a plurality of nails, or the like that would be utilized to hang a picture 24, mirror or the like. The kit may also include more than one retention member 12, more than one nail 14, and more than one tube 16. The kit may also include varying sizes of retention members 12, nails 14, and tubes 16. The kit may also include a set of instructions for using the picture hanging device 10.

It will be known by one of ordinary skill in the art to have a tube 16 of multiple sizes and dimensions, depending upon the uses by the user. The tube 16 may be composed of plastic, but could also be composed of a material other than plastic, such as nylon, rubber, paper product, plastic composites or the like, that has similar rigidity and/or flexibility, is light weight, and has similar durability as plastic.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A picture hanging device for mounting a picture to a retention member engaged to a wall, comprising:

a tube having a top portion and a bottom portion;

a retention member that has an upper portion and a lower portion, and the upper portion is bent in upon itself and has a bore extending therethrough and the lower portion is angled upward;

the bottom portion of the tube and the top portion of the tube have a varying geometry in that the bottom portion of the tube is cylindrical with a constant inner and outer diameter that is designed to receive the lower portion of the retention member mounted to a wall and the top portion of the tube is flattened, thus forming two sides engaged to one another;

an indicator positioned in the center of the top portion of the tube that is flattened and indicating the center of the tube;

the top portion of the tube extends into the air for correctly aligning the picture on the retention member; and whereby a hanging mechanism engaged to the picture is positioned around the tube and is slid down the tube for engagement to the retention member and the indicator positioned on the tube is positioned within the center of the picture for correctly aligning the picture on the retention member.

2. The picture hanging device of claim 1, wherein the tube is composed of plastic.

* * * * *